US008191657B2

(12) United States Patent
Richert et al.

(10) Patent No.: US 8,191,657 B2
(45) Date of Patent: Jun. 5, 2012

(54) ROTARY DRAG BITS FOR CUTTING CASING AND DRILLING SUBTERRANEAN FORMATIONS

(75) Inventors: Volker Richert, Celle/Gross-Hehlen (DE); Henning Finke, Pattensen (DE)

(73) Assignee: Baker Hughes Incorporated, Houston, TX (US)

( * ) Notice: Subject to any disclaimer, the term of this patent is extended or adjusted under 35 U.S.C. 154(b) by 246 days.

(21) Appl. No.: 12/473,980

(22) Filed: May 28, 2009

(65) Prior Publication Data

US 2010/0300673 A1 Dec. 2, 2010

(51) Int. Cl.
*E21B 10/43* (2006.01)
*E21B 10/46* (2006.01)

(52) U.S. Cl. ..... 175/431; 175/428; 175/432; 175/434

(58) Field of Classification Search ..... 175/428, 175/431, 432, 434, 426
See application file for complete search history.

(56) References Cited

U.S. PATENT DOCUMENTS

| | | | | |
|---|---|---|---|---|
| 228,780 | A | 6/1880 | Von Ringharz | |
| 3,727,704 | A | 4/1973 | Abplanalp | |
| 3,825,080 | A | 7/1974 | Short | |
| 4,499,958 | A | 2/1985 | Radtke et al. | |
| 4,813,500 | A | 3/1989 | Jones | |
| 4,943,488 | A | 7/1990 | Sung et al. | |
| 5,049,164 | A | 9/1991 | Horton et al. | |
| 6,123,161 | A | 9/2000 | Taylor | |
| 6,253,863 | B1 | 7/2001 | Mensa-Wilmot et al. | |
| 6,474,425 | B1 | 11/2002 | Truax et al. | |
| 6,510,906 | B1 | 1/2003 | Richert et al. | |
| 6,843,333 | B2 | 1/2005 | Richert et al. | |
| 6,883,623 | B2 | 4/2005 | McCormick et al. | |
| 7,025,156 | B1 | 4/2006 | Caraway | |
| 7,267,175 | B2 | 9/2007 | Haugen et al. | |
| 7,278,499 | B2 | 10/2007 | Richert et al. | |
| 7,284,623 | B2 | 10/2007 | Rock | |
| 2006/0162966 | A1 * | 7/2006 | Richert et al. | 175/348 |
| 2007/0284153 | A1 | 12/2007 | Richert et al. | |
| 2008/0135307 | A1 | 6/2008 | Richert | |

* cited by examiner

*Primary Examiner* — Giovanna Wright

(74) *Attorney, Agent, or Firm* — TraskBritt

(57) ABSTRACT

A drill bit for cutting casing employing a plurality of discrete, abrasive particulate-impregnated cutting structures having cutting structures therein extending upwardly from abrasive particulate-impregnated blades, which define a plurality of fluid passages therebetween on the bit face. Additional cutting elements may be placed in the inverted cone of the bit surrounding the centerline thereof.

30 Claims, 6 Drawing Sheets

ROTARY DRAG BITS FOR CUTTING CASING AND DRILLING SUBTERRANEAN FORMATIONS

TECHNICAL FIELD

The present invention relates generally to fixed cutter, or "drag" type bits for drilling through casing and side track boreholes and, more specifically, to drag bits for drilling through casing and formations, and especially for drilling through casing, cement outside the casing, cement and float shoes, and into highly abrasive formations.

BACKGROUND

So-called "impregnated" drag bits are used conventionally for drilling hard and/or abrasive rock formations, such as sandstone. The impregnated drill bits conventionally employ a cutting face composed of superabrasive particles, such as diamond grit, dispersed within a matrix of wear resistant material. As such a bit drills, the matrix and embedded diamond particles wear, cutting particles are lost as the matrix material wears, and new cutting particles are exposed. These diamond particles may either be natural or synthetic, and may be cast integral with the body of the bit, as in low-pressure infiltration, or may be preformed separately, as in hot isostatic pressure (HIP) infiltration, and attached to the bit by brazing or furnaced to the bit body during manufacturing thereof by an infiltration process, if the bit body is formed of, for example, tungsten carbide particles infiltrated with a metal alloy binder.

During the drilling of a well bore, the well may be drilled in multiple sections wherein at least one section is drilled, followed by the cementing of a tubular metal casing within the borehole. In some instances, several sections of the well bore may include casing of successively smaller sizes, or a liner may be set in addition to the casing. In cementing the casing (such term including a liner) within the borehole, cement is conventionally disposed within an annulus defined between the casing and the borehole wall by flowing the cement downwardly through the casing to the bottom thereof and then displacing the cement through a so-called "float shoe" such that it flows back upwardly through the annulus. Such a process conventionally results in a mass or section of hardened cement proximate the float shoe and formed at the lower extremity of the casing. Thus, in order to drill the well bore to further depths, it becomes necessary to first drill through the float shoe and mass of cement.

In other instances, during drilling a well bore, the well bore must be "side tracked" by drilling through the casing, through cement located outside the casing, and into one or more formations laterally adjacent to the casing to continue the well bore in the direction desired.

Conventionally, a drill bit used to drill out cement and a float shoe to drill ahead of the existing well bore path does not exhibit the desired design for drilling the subterranean formation which lies therebeyond. Thus, those drilling the well bore are often faced with the decision of changing out drill bits after the cement and float shoe have been penetrated or, alternatively, continuing with a drill bit which may not be optimized for drilling the subterranean formation below the casing.

Also, a drill bit used to drill out casing for continuing boreholes in a directional well does not exhibit the desired design for drilling the subterranean formation which lies therebeyond. Thus, those drilling the well bore are often faced with the decision of changing out drill bits after the casing and cement have been penetrated or, alternatively, continuing with a drill bit which may not be optimized for drilling the subterranean formation adjacent to the casing.

In very hard and abrasive formations, such as the Bunter Sandstone in Germany, conventional side track bits wear out quickly, often before cutting a complete window in the casing and in general within a few meters, during the high build angle toward a lateral wellbore path.

Thus, it would be beneficial to design a drill bit which would perform more aggressively in softer, less abrasive formations while also providing adequate rate of penetration (ROP) and enhanced durability in harder, more abrasive formations without requiring increased weight-on-bit (WOB) during the drilling process.

Additionally, it would be advantageous to provide a drill bit with "drill out" features that enable the drill bit to drill through casing, cement outside the casing, or a cement shoe and continue drilling the subsequently encountered subterranean formation in an efficient manner for an extended interval.

BRIEF SUMMARY OF THE INVENTION

The present invention comprises a rotary drag bit employing impregnated cutting elements on the blades of the rotary drag bit, the blades defining fluid passages therebetween extending to junk slots on the bit gage. An inverted cone portion of the bit face is provided with a center post having cutting elements such as, for example, superabrasive cutting elements comprising one or more of polycrystalline diamond compact (PDC) cutting elements, thermally stable polycrystalline diamond compact (TSP) cutting elements, and natural diamond. The cone, nose and shoulder portions of the bit face are provided with superabrasive impregnated cutting elements having two or more thermally stable polycrystalline diamond compact (TSP) cutting structures therein. Optionally, the gage is provided with natural diamonds.

In an embodiment of the invention, the blades are of a superabrasive-particle-impregnated matrix material and extend generally radially outwardly from locations within or adjacent to the inverted cone at the centerline of the bit, the blades having discrete cutting structures of superabrasive-impregnated materials and TSP cutting structures therein and protruding therefrom. The discrete cutting structures may exhibit a generally triangular cross-sectional geometry taken in a direction that is normal to an intended direction of bit rotation. Such discrete cutting structures enable the bit to drill through features such as casing and a cement shoe at the bottom of a well bore casing.

DETAILED DESCRIPTION OF THE INVENTION

Figure 1:
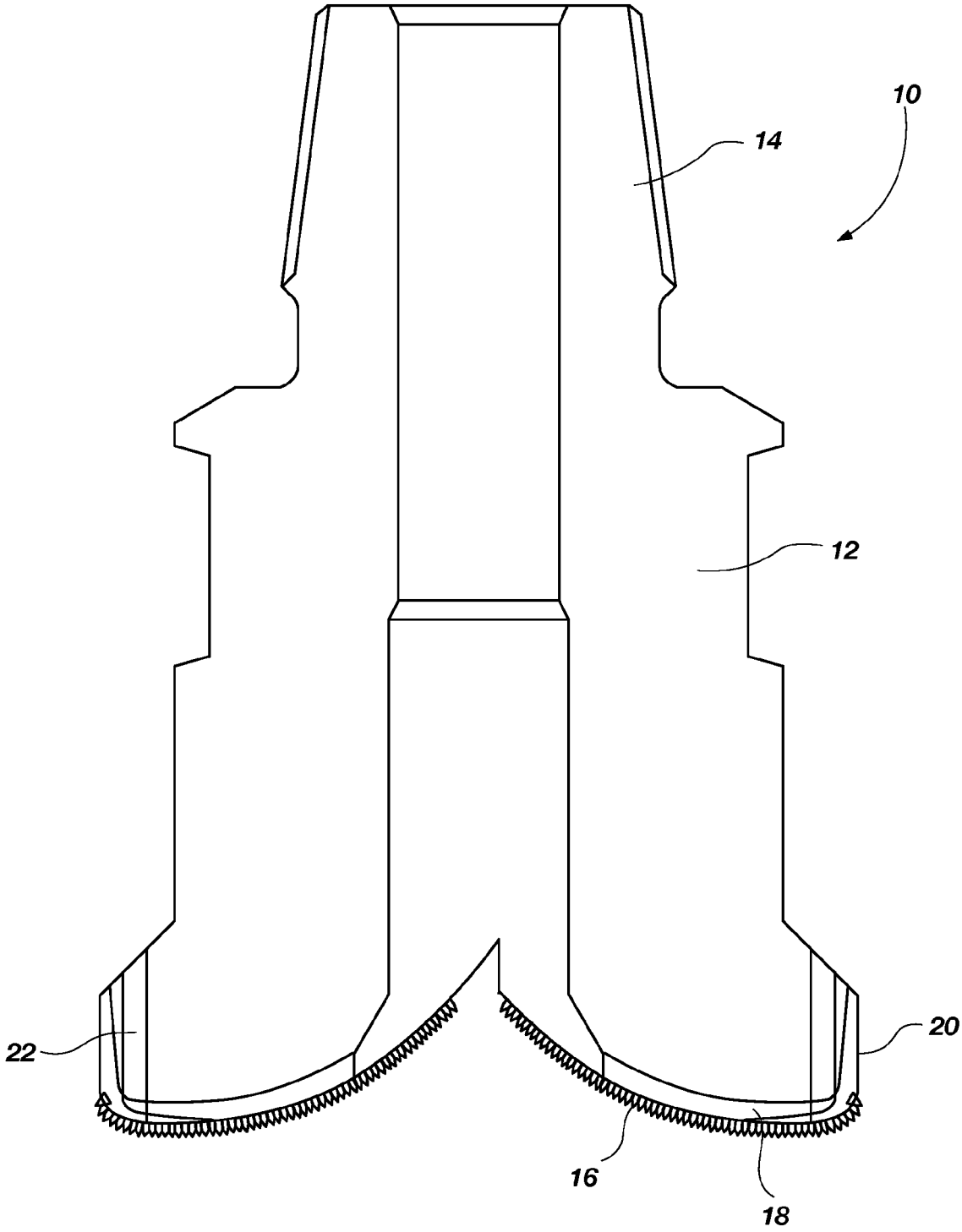
FIG. 1 (PRIOR ART)
FIG. 1 is a cross-sectional view of a prior art drill bit.

Illustrated in FIG. 1 is a cross-sectional view of a prior art drag-type side track drill bit 10 used to drill through casing, cement outside the casing and formations thereafter.

The bit 10 includes a matrix-type bit body 12 having a shank 14 for connection to a drill string (not shown) extending therefrom opposite a bit face 16. A number of blades 18 extend generally radially outwardly in linear fashion to gage pads 20 and define junk slots 22 therebetween.

Figure 2:
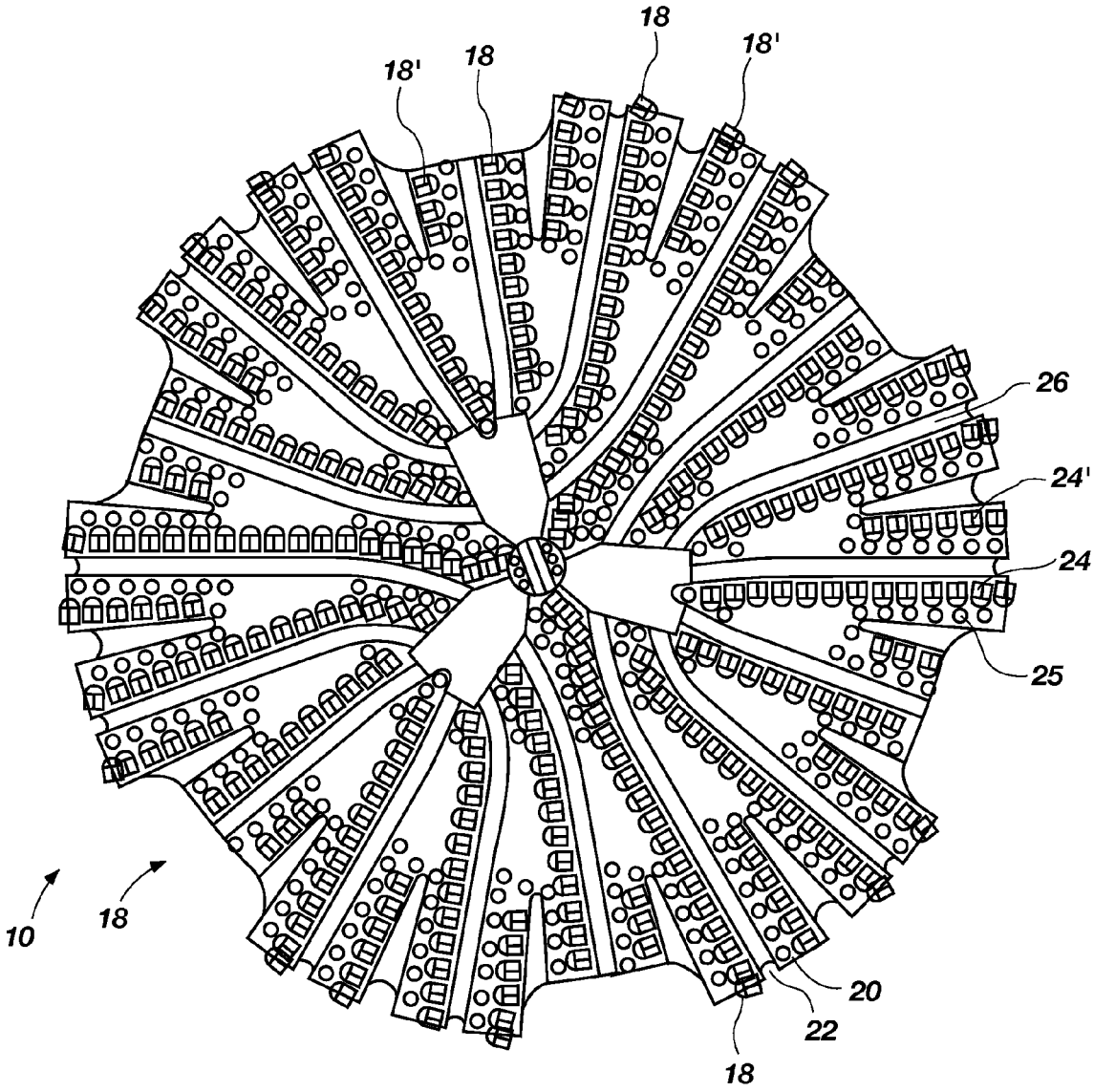
FIG. 2 (PRIOR ART)
FIG. 2 is a frontal or face view of the prior art drill bit of FIG. 1.

Illustrated in FIG. 2 is a view of the face 16 of the bit body 12 (FIG. 1) having blades 18 thereon with the blades 18 having a plurality of cutters 24 located thereon with flow channels 26 extending from the center of the bit 10 to the junk slots 22. As illustrated, some of the blades 18' are longer than other blades 18 so that the bit 10 has six sections thereof having longer blades 18' thereon and six sections thereof having shorter blades 18 thereon. Notably, the blades 18 are of small exposure above the face 16, and the flow channels 26 are extremely narrow. The cutters 24 comprise discrete protrusions 24' formed, for example, of single TSP elements. Optionally, round natural diamonds 25 may be set in blades 18 and 18' rotationally behind cutters 24. The blades 18 comprise primary blades 18 and secondary blades 18'. However, the blades 18 and 18' of the bit 10 do not comprise superabrasive material and, thus, are not sufficiently durable for continuing to drill abrasive formations if the cutters 24 on the blades 18 are damaged or removed from the blades 18 during drilling a window through the casing and surrounding cement, as well as due to the blades 18 wearing substantially during drilling through the casing.

Figure 3:
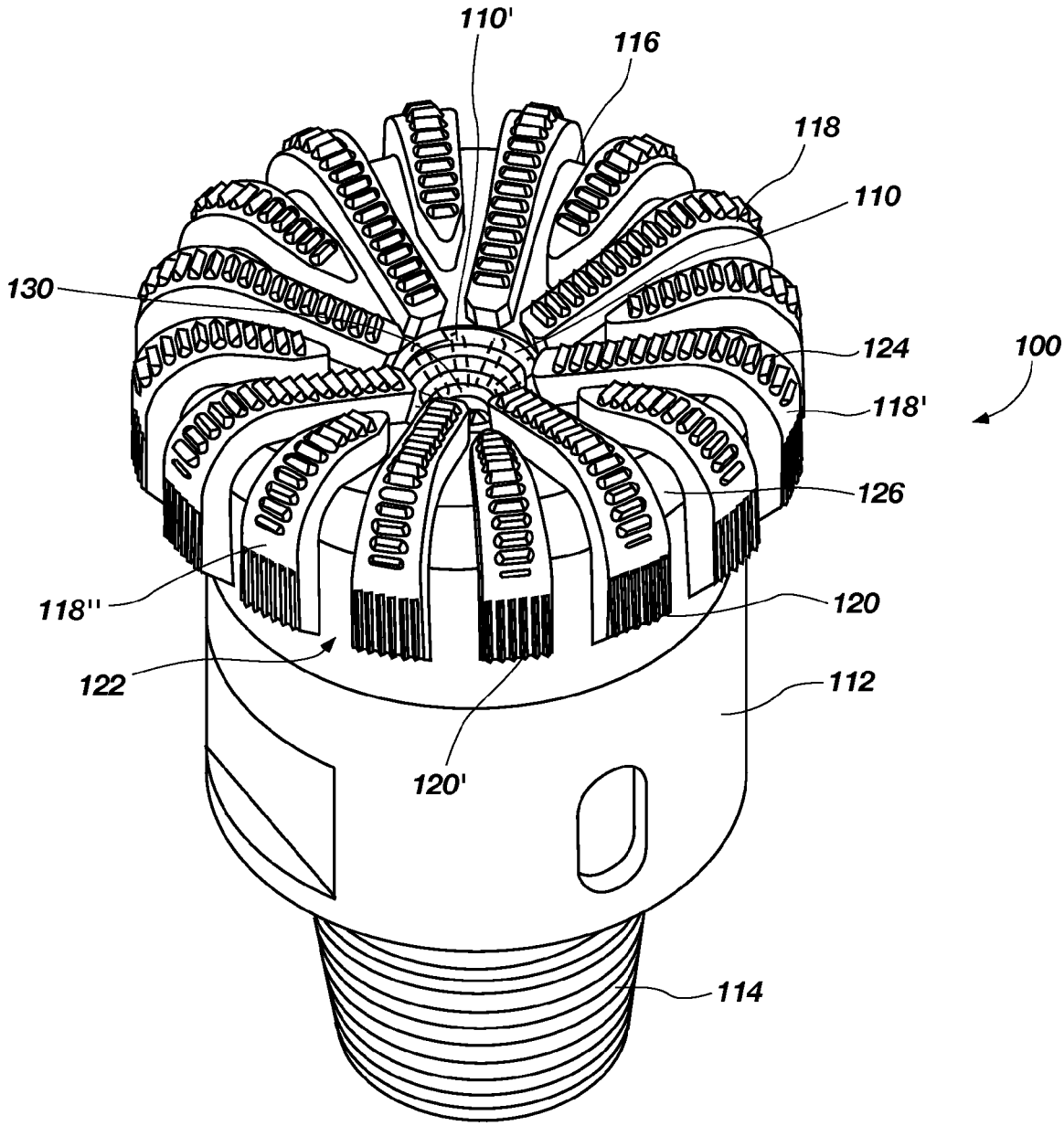
FIG. 3 is a perspective view of a drill bit of the present invention.

Illustrated in FIG. 3 in a perspective view, is drill bit 100 of the present invention suitable for use in cutting through casing, cement, cement and float shoes, and formations thereafter. The drill bit 100 includes a matrix-type bit body 112 having a shank 114, for connection with a drill string (not shown), the shank 114 extending opposite a bit face 116. The drill bit 100 also includes a plurality of blades 118 extending generally radially outwardly in a linear manner with each blade 118 extending to a gage pad 120' on the gage 120 of the drill bit 100 with the blades 118 having junk slots 122 therebetween. The gage pads 120' are set with diamonds, such as natural diamonds, to reduce the wear on the gage 120 of the drill bit 100 during drilling. If desired, the gage pads 120' may be set with synthetic diamonds or no diamonds. The drill bit 100 comprises a plurality of primary blades 118' and secondary blades 118", the primary blades 118' extending from an inverted cone 110 of the drill bit 100 radially in a linear manner through the cone 132, the nose 134, the shoulder 136, and the gage 120 of the drill bit 100 while the secondary blades 118" extend radially in a linear manner from the outer boundary of the nose 134, through the shoulder 136, and through the gage 120 of the drill bit 100 (see FIG. 4). The inverted cone 110 of the drill bit 100 of the present invention and the method of manufacturing the drill bit 100 of the present invention are set forth in U.S. Pat. No. 7,278,499, the disclosure of which is incorporated herein in its entirety. The inverted cone 110 includes a center post 130 and fluid passageways 110' therein which communicate with flow channels 126 of the drill bit 100 (see FIG. 4).

Discrete cutting structures 124 located on the blades 118 of drill bit 100 comprise generally rectangular structures having semicircular ends rising above the blades 118 with the discrete cutting structures 124 formed of diamond-impregnated sintered carbide material having at least two TSP material cutting structures 125 (see FIG. 5) set in portions of the blades 118 of the drill bit 100 within the discrete cutting structures 124. As depicted, the TSP material cutting structures may have an outer boundary coextensive with that of the diamond-impregnated sintered carbide material, although this is not required. Although the discrete cutting structures 124 are generally rectangular in shape, any desired geometric shape may be used on the blades 118. The discrete cutting structures 124 comprise sintered metal carbide material, such as tungsten carbide, and including a synthetic diamond grit mixed therein, such as, for example, DSN-47 Synthetic diamond grit, commercially available from DeBeers of Shannon, Ireland. Such grit has demonstrated toughness superior to natural diamond grit and TSP material cutting structures. The TSP material may be as described in U.S. Pat. No. 6,510,906, the disclosure of which is incorporated herein in its entirety. Each discrete cutting structure 124 located on the drill bit 100 includes at least two or more TSP material cutting structures 125 located within a discrete cutting structure 124, each TSP material cutting structure 125 at least abutted and, optionally surrounded, by diamond-impregnated sintered carbide material, each TSP material cutting structure 125 exhibiting a substantially triangular cross-sectional geometry having a generally sharp outermost edge, as taken normal to the intended direction of bit rotation, with the base of the triangle of the TSP material cutting structure 125 embedded in the blades 118 and being mechanically and metallurgically bonded thereto. The TSP material cutting structure 125 may be coated with, for example, a refractory material as known in the art and disclosed in U.S. Pat. Nos. 4,943,488 and 5,049,164, the disclosures of each of which are hereby incorporated herein in their entirety. Such refractory materials may include, for example, a refractory metal, a refractory metal carbide, a refractory metal oxide, or combinations thereof. The coating may exhibit a thickness of approximately 1 to 10 microns.

The bit body 112 of the drill bit 100 comprises a matrix-type bit body 112 formed by hand-packing diamond grit-impregnated matrix material in mold cavities on the interior of the bit mold defining the locations of the blades 118 and discrete cutting structures 124 and, thus, each blade 118 and its associated discrete cutting structures 124 defines a unitary structure. If desired, the bit body 112 may be entirely formed of diamond grit-impregnated matrix material, such as that of the discrete cutting structures 124.

Illustrated further in FIG. 3 in a perspective view is drill bit 100 of the present invention including a bit face 116, a bit body 112 having blades 118 thereon having a plurality of discrete cutting structures 124 thereon with flow channels 126 extending from the center of the drill bit 100 to junk slots 122. The drill bit 100 includes an inverted cone 110 therein having fluid passageways 110' shown in broken lines therein for feeding drilling fluid from the interior of the drill bit 100 to flow channels 126 on the face 116 of the drill bit 100. The tungsten carbide matrix material with which the diamond grit is mixed to form discrete cutting structures 124 and blades 118 as well as, optionally, portions of the bit body 112 may desirably include a fine grain carbide, such as, for example, DM2001 powder commercially available from Kennametal, Inc., of Latrobe, Pa. Such a carbide powder, when infiltrated, provides increased exposure of the diamond grit particles in comparison to conventional matrix materials due to its relatively soft, abradable nature. The base of each blade 118 may desirably be formed of, for example, a more durable tungsten carbide powder matrix material, obtained from Firth MPD of Houston, Tex. Use of the more durable matrix material in this region helps to prevent ring-out even if all of the discrete cutting structures 124 are abraded away and the majority of each blade 118 is worn.

It is noted, however, that alternative particulate abrasive materials may be suitably substituted for those discussed above. For example, the discrete cutting structures 124 may include natural diamond grit, or a combination of synthetic and natural diamond grit. Alternatively, the discrete cutting structures 124 may include synthetic diamond pins, rather than TSP material cutting structures 125 having a triangular shape therein. Additionally, the particulate abrasive material may be coated with single or multiple layers of a refractory material, as known in the art and disclosed in previously incorporated by reference U.S. Pat. Nos. 4,943,488 and 5,049,164. As noted above, suitable refractory materials may include, for example, a refractory metal, a refractory metal carbide or a refractory metal oxide, and the coating may exhibit a thickness of approximately 1 to 10 microns.

Figure 4:
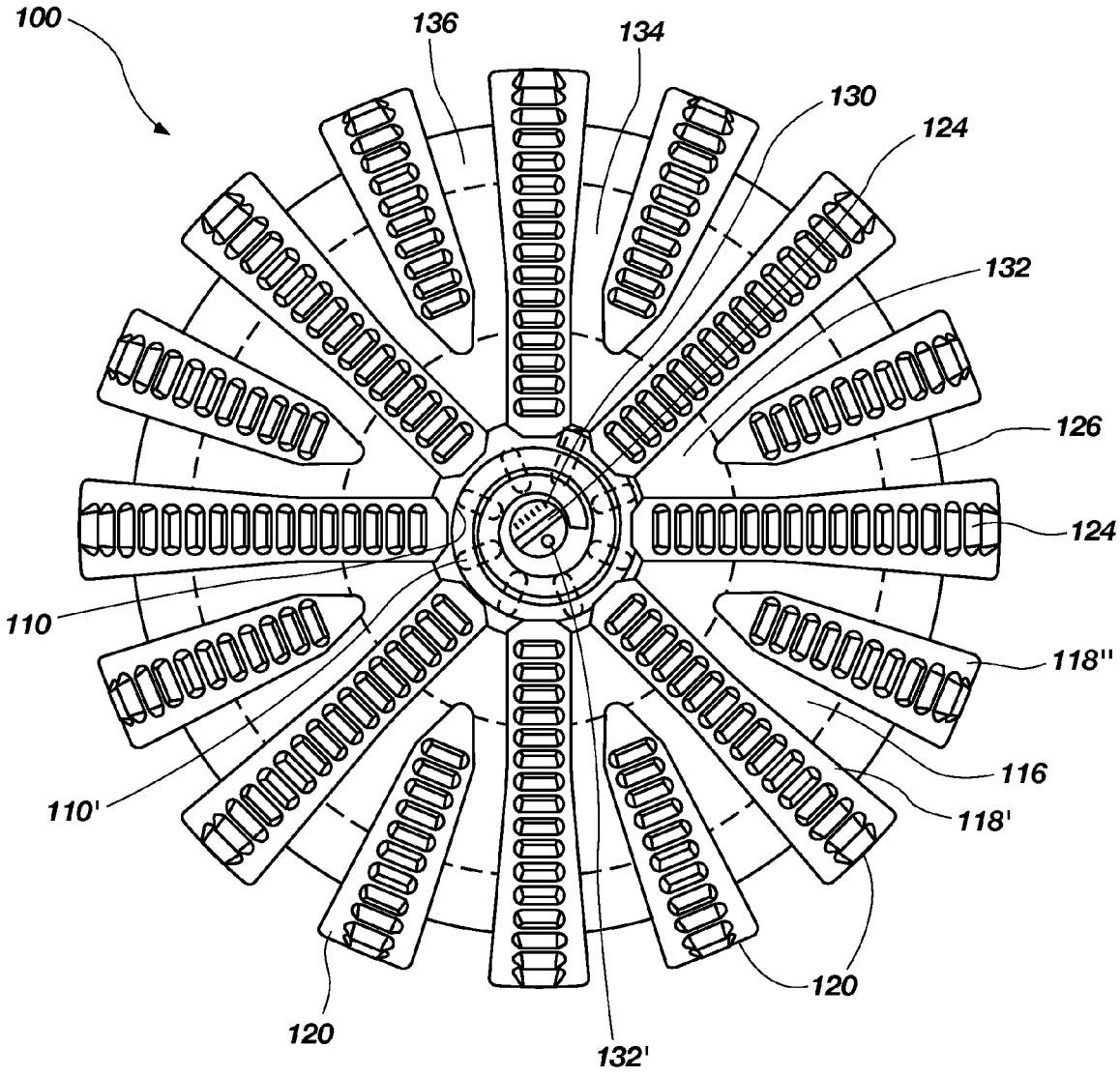
FIG. 4 is a frontal or face view of the drill bit of the present invention.

Illustrated in FIG. 4 is a frontal or face view of the bit face 116 showing the primary blades 118' having discrete cutting structures 124 thereon, secondary blades 118" having discrete cutting structures 124 thereon, flow channels 126 which extend from the inverted cone 110 having fluid passageways 110' therein in the center of the drill bit 100 to the gage 120 thereof, and center post 130 having cutters 132' located thereon in the center of the inverted cone 110 of the drill bit 100. The discrete cutting structures 124 located on the primary blades 118' and the discrete cutting structures 124 located on the secondary blades 118" overlap radially (see circumferentially oriented arrows in FIG. 5) so that drill bit 100 produces smooth cuttings during drilling and so that the drill bit 100 reduces any tendency toward ring-out of the formation during drilling. Each primary blade 118' has one secondary blade 118" located therebetween with the secondary blades 118" extending radially in a generally linear configuration from the nose 134 of the drill bit 100 commencing proximate the outer edge of the cone 132, through the shoulder 136 of the drill bit 100, to the gage 120 of the drill bit 100 while the primary blades 118' extend radially in a generally linear configuration from substantially within the cone 132 of the drill bit 100, through the nose 134 of the drill bit 100, through the shoulder 136 of the drill bit 100, to the gage 120 of the drill bit 100. By the placement of the secondary blades 118" extending radially outwardly from the nose 134 on the drill bit 100 having only one secondary blade 118" located between two primary blades 118', large flow channels 126 on the face 116 of the drill bit 100 are created for the drilling mud to flow therethrough during drilling from the inverted cone 110 of the drill bit 100. While the discrete cutting structures 124 have been illustrated as rising above the blades 118, the discrete cutting structures 124 may be formed therein, if desired. Further, the TSP material cutting structure 125 (see FIG. 5) may extend above the rectangular structure forming the discrete cutting structure 124 on a blade 118, by a predetermined amount, if desired.

Figure 5:
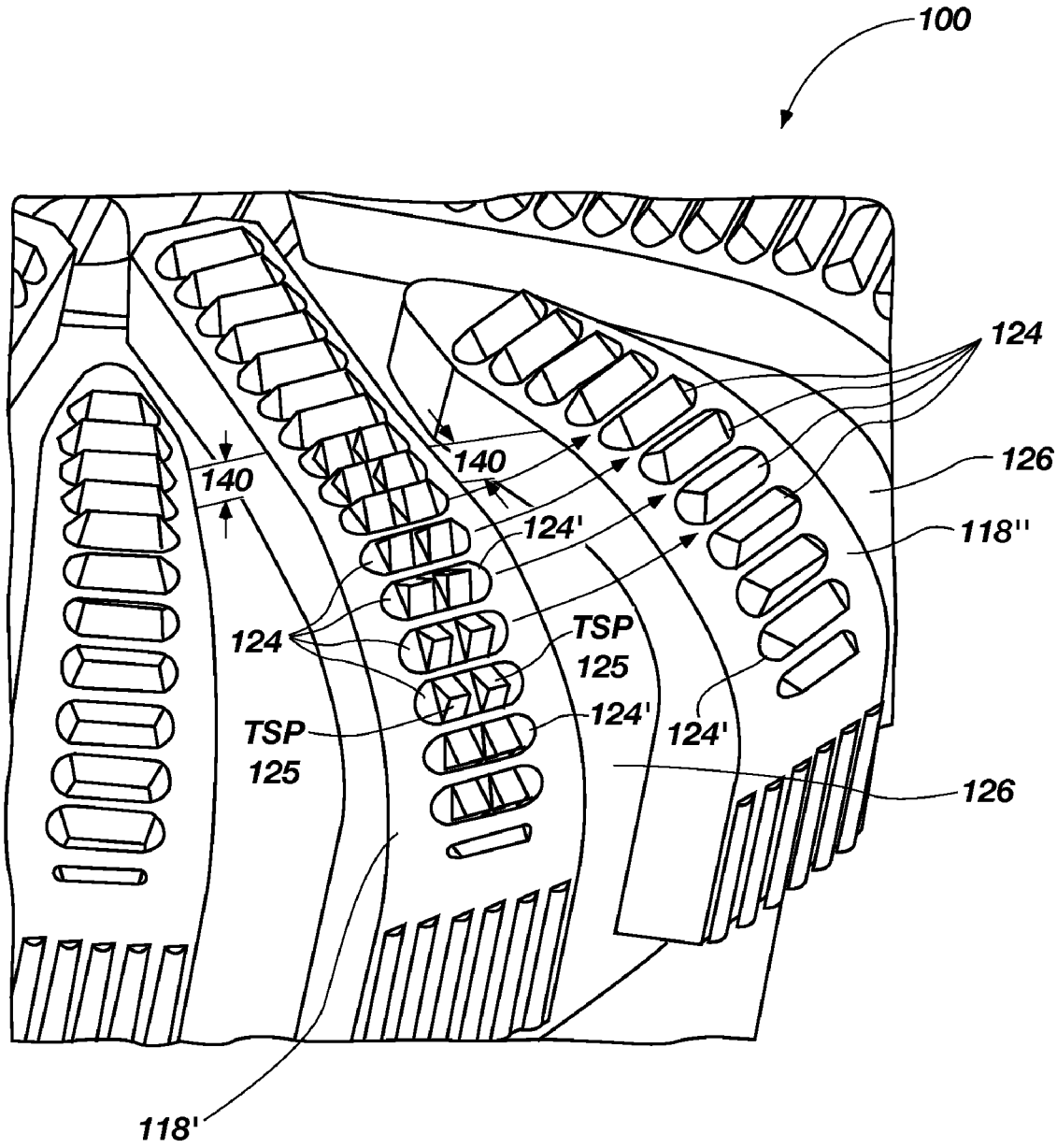
FIG. 5 is a perspective view of a portion of the face of the drill bit of the present invention.

Illustrated in FIG. 5 are the discrete cutting structures 124 having two or more TSP material cutting structures 125 located therein. Further illustrated in FIG. 5 is the radial overlapping of the discrete cutting structures 124 between the primary blades 118' and the secondary blades 118" as shown by the arrows extending from the discrete cutting structures 124 on the primary blade 118' to the space between discrete cutting structures 124 on a secondary blade 118". Each discrete cutting structure 124 is formed in the shape of an elongated rectangle having semicircular ends 124' thereon to enable the discrete cutting structure 124 to retain the TSP material cutting structures 125 located therein. While only two TSP material cutting structures 125 have been shown located in the discrete cutting structures 124, any desired number can be used depending upon the size of the TSP material cutting structures 125 and the widths of the primary blade 118' and of the secondary blade 118", measured circumferentially in the direction of intended bit rotation. Additionally, a relatively greater thickness (height) 140 of a primary blade 118' and of a secondary blade 118" creates a greater blade exposure than in conventional side track bits, thereby improving the durability of the drill bit 100 since the primary blades 118' and secondary blades 118" are diamond grit-impregnated matrix material. Even when the discrete cutting structures 124 have been worn from the primary blades 118' and the secondary blades 118", the primary blades 118' and the secondary blades 118" will continue cutting. Although the thickness 140 of a primary blade 118' and a secondary blade 118" will vary with the location on a portion of the face 116 of the drill bit 100 and the size of the drill bit 100, a preferred minimum thickness of at least 0.50 inch or more is desirable for both durability of the blades 118 and to enhance the flow of drilling fluid through flow channels 126 to clear drilling debris from the face 116 of drill bit 100 during drilling. While the TSP material cutting structures 125 are described as having a triangular cross-section at the cutting end thereof, they may exhibit other geometries as well, such as a generally square or rectangular cross-sectional geometry, or a generally semicircular geometry as taken normal to the intended direction of bit rotation and, thus may respectively exhibit a generally flat outermost end or a generally rounded or semicircular cross-sectional area, as taken normal to the intended direction of bit rotation. While the end of the TSP material cutting structure 125 may have a variety of shapes, the TSP material cutting structure 125 is set with the discrete cutting structure 124, each of which have semicircular ends 124' thereon which lead and trail each discrete cutting structure 124 in the direction of rotation of the drill bit 100. The semicircular end 124' at least initially protects the TSP material cutting structure 125 within the discrete cutting structure 124 from wear by the casing, the cement, and the formation during drilling.

Figure 6:
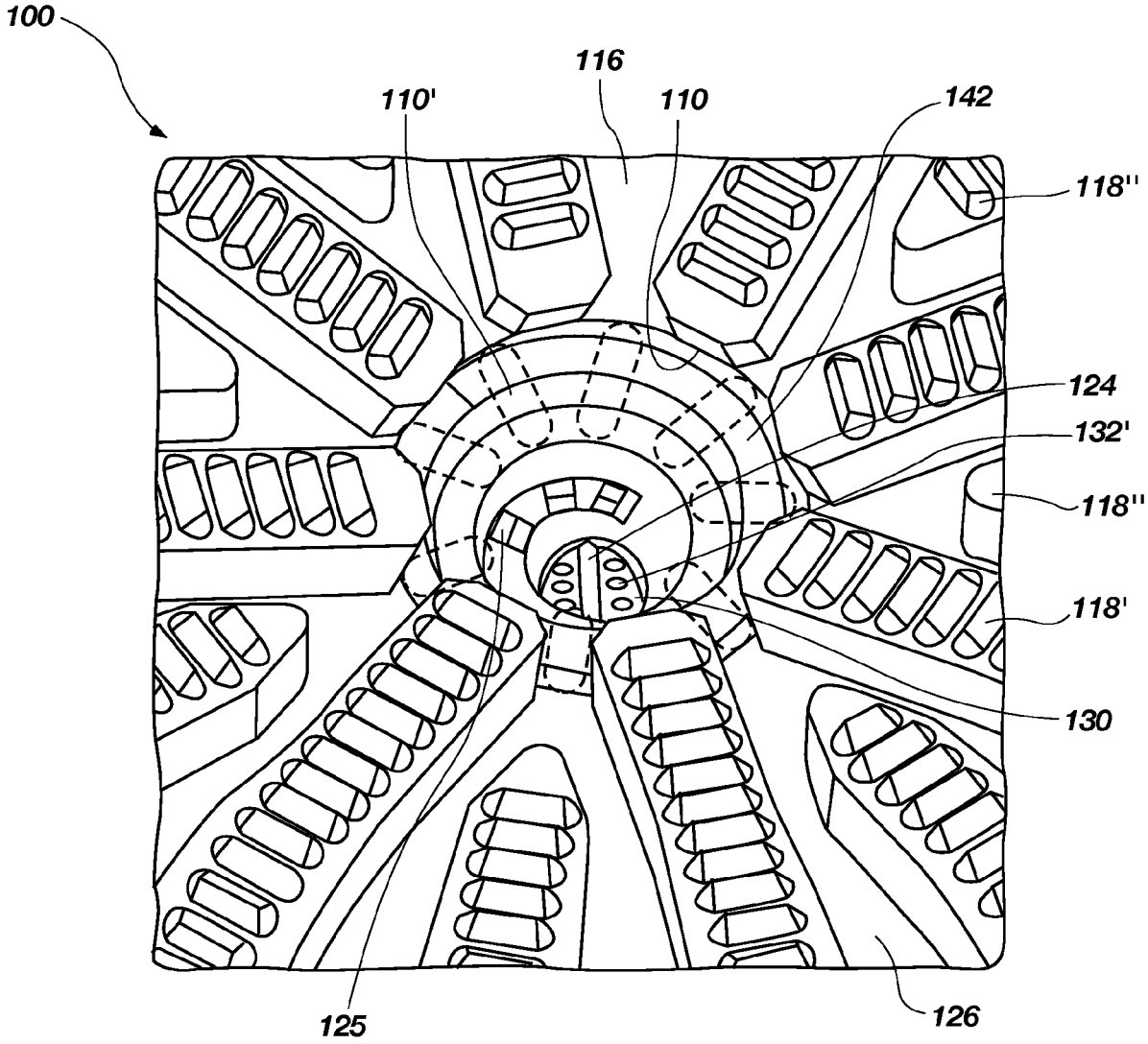
FIG. 6 is a perspective view of a portion of the face of the drill bit of the present invention.

Illustrated in FIG. 6 is the center portion of the face 116 of the drill bit 100 showing the center post 130 located in the inverted cone 110 having fluid passages 110' therein in the center of the drill bit 100. The center post 130 may include a discrete cutting structure 124, if desired, extending across a diameter of the center post 130, a plurality of PDC cutters 132' located thereon, and fluid passageways 110' (shown in broken lines) are disposed therearound. The surface 142 of the drill bit 100 surrounding the center post 130 may include TSP or natural diamond cutters thereon, which are ridge-set, helix-set or radial-set, or a number of PDC cutters, as desired. As depicted, surface 142 comprises a helix and TSP material cutting structures 125 (only three shown for clarity) may be set therealong. The inverted cone 110 includes fluid apertures therein (not shown) to communicate with the flow channels 126 on the face 116 of drill bit 100.

While the bits of the present invention have been described with reference to certain embodiments, those of ordinary skill in the art will recognize and appreciate that it is not so limited. Additions, deletions and modifications to the embodiments illustrated and described herein may be made without departing from the scope of the invention as defined by the claims herein and their legal equivalents. Similarly, features from one embodiment may be combined with those of another.

What is claimed is:

1. A rotary drag bit for cutting casing and drilling subterranean formations, comprising:

a bit body having a face extending from a centerline to a gage;

an inverted cone formed in the face of the bit body;

a plurality of blades comprising a particulate abrasive material on the face and extending generally radially outwardly toward the gage; and a plurality of discrete, mutually separated cutting structures protruding from at least one blade of the plurality of blades, at least one cutting structure of the plurality of discrete, mutually separated cutting structures comprising a particulate abrasive material and at least two cutting elements formed at least partially within the at least one cutting structure of the plurality of discrete, mutually separated cutting structures, wherein one cutting element of the at least two cutting elements rotationally leads at least another cutting element of the at least two cutting elements in a direction of intended rotary drag bit rotation.

2. The rotary drag bit of claim 1, wherein the plurality of discrete, mutually separated cutting structures and the plurality of blades comprise unitary structures.

3. The rotary drag bit of claim 1, wherein the particulate abrasive material comprises a sintered carbide material impregnated with at least one of synthetic diamond grit and natural diamond grit and wherein the at least two cutting elements of the at least one cutting structure of the plurality of discrete, mutually separated cutting structures comprise a thermally stable diamond product (TSP).

4. The rotary drag bit of claim 1, wherein a portion of each of the plurality of discrete, mutually separated cutting structures is configured generally as a rectangle having semicircular ends thereon.

5. The rotary drag bit of claim 1, wherein the inverted cone includes a plurality of fluid passages therein.

6. The rotary drag bit of claim 1, wherein the face includes at least one cutting element disposed within the inverted cone radially inwardly of the plurality of blades.

7. The rotary drag bit of claim 6, wherein the at least one cutting element comprises at least one of a polycrystalline diamond compact (PDC) cutting element, a thermally stable diamond product (TSP), a material comprising natural diamond, and a diamond-impregnated material.

8. The rotary drag bit of claim 1, wherein the plurality of blades includes a plurality of primary blades and a plurality of secondary blades.

9. The rotary drag bit of claim 1, wherein the bit body comprises a matrix-type bit body, and the plurality of blades is integral with the bit body.

10. The rotary drag bit of claim 9, wherein the plurality of discrete, mutually separated cutting structures is integral with the plurality of blades and the bit body.

11. The rotary drag bit of claim 10, wherein the plurality of discrete, mutually separated cutting structures and the plurality of blades comprise a metal matrix material, and the particulate abrasive material comprises a diamond grit material.

12. The rotary drag bit of claim 1, wherein the particulate abrasive material includes a coating including a refractory material.

13. The rotary drag bit of claim 12, wherein the refractory material comprises at least one of a refractory metal, a refractory metal carbide, and a refractory metal oxide.

14. The rotary drag bit of claim 13, wherein the refractory material coating exhibits a thickness of approximately 1 to 10 microns.

15. The rotary drag bit claim 1, wherein the at least two cutting elements of the at least one cutting structure of the plurality of discrete, mutually separated cutting structures extend outwardly from the particulate abrasive material.

16. The rotary drag bit of claim 1, wherein each of the at least two cutting elements of the at least one cutting structure of the plurality of discrete, mutually separated cutting structures includes a substantially triangular cross-sectional taken in a direction normal to a direction of intended bit rotation.

17. The rotary drag bit of claim 1, wherein each of the plurality of discrete, mutually separated cutting structures is formed with a blade of the plurality of blades.

18. The rotary drag bit of claim 1, wherein each of the plurality of discrete, mutually separated cutting structures is located on the surface of a blade of the plurality of blades.

19. A rotary drag bit for cutting casing and drilling subterranean formations, comprising:

a bit body having a face extending from a centerline to a gage, the face including an inverted cone surrounding the centerline; and a plurality of cutting structures located on the face external of the inverted cone and protruding from the face, the plurality of cutting structures comprising a plurality of discrete, mutually separated generally rectangular members, each discrete, mutually separated rectangular member comprising a particulate abrasive material and at least two thermally stable diamond product (TSP) material cutting structures formed substantially entirely within the discrete, mutually separated rectangular member.

20. The rotary drag bit of claim 19, wherein the particulate abrasive material comprises at least one of synthetic diamond grit and natural diamond grit.

21. The rotary drag bit of claim 19, further comprising a plurality of blades on the face extending generally radially outwardly toward the gage, each blade of the plurality having at least one of the plurality of cutting structures positioned thereon.

22. The rotary drag bit of claim 21, wherein each of the plurality of discrete, mutually separated generally rectangular members and an associated blade comprises a unitary structure.

23. The rotary drag bit of claim 22, wherein the plurality of blades is formed of a particulate abrasive material.

24. The rotary drag bit of claim 19, further comprising at least one cutting element disposed within the inverted cone.

25. The rotary drag bit of claim 24, wherein the at least one cutting element comprises at least one of a polycrystalline diamond compact (PDC) cutting element, a thermally stable diamond product (TSP), a material comprising natural diamonds, and a diamond-impregnated material.

26. The rotary drag bit of claim 19, wherein the particulate abrasive material comprises a coating including a refractory material.

27. A rotary drag bit for cutting casing and drilling subterranean formations, comprising:

a bit body having a face extending from a centerline to a gage, the face including an inverted cone surrounding the centerline; and a plurality of cutting structures located on the face external of the inverted cone and protruding from the face, the plurality of cutting structures comprising a plurality of discrete, mutually separated generally rectangular members, each discrete, mutually separated rectangular member comprising a particulate abrasive material and at least two thermally stable diamond product (TSP) material cutting structures formed substantially within the discrete, mutually separated rectangular member, wherein a center post within the inverted cone and the bit face comprise a unitary structure.

28. The rotary drag bit of claim 27, wherein the bit body comprises a matrix-type bit body.

29. A rotary drag bit for cutting casing and drilling subterranean formations, comprising:

a bit body having a face extending from a centerline to a gage, the face including an inverted cone surrounding the centerline; and a plurality of cutting structures located on the face external of the inverted cone and protruding from the face, the plurality of cutting structures comprising a plurality of discrete, mutually separated generally rectangular members, each discrete, mutually separated rectangular member comprising a particulate abrasive material and at least two thermally stable diamond product (TSP) material cutting structures formed substantially within the discrete, mutually separated rectangular member, wherein each of the at least two thermally stable diamond product (TSP) material cutting structures extends outwardly coincident with an extent of the particulate abrasive material of at least one discrete, mutually separated generally rectangular member.

30. The rotary drag bit of claim 29, wherein each of the at least two thermally stable diamond product (TSP) material cutting structures includes at least one of a substantially triangular cross-sectional geometry, a substantially square cross-sectional geometry and a substantially semicircular cross-sectional geometry taken in a direction normal to a direction of intended bit rotation.

* * * * *